US005613877A

United States Patent [19]

Patel et al.

[11] Patent Number: 5,613,877

[45] Date of Patent: Mar. 25, 1997

[54] ELECTRIC CONNECTOR BOARDLOCK

[75] Inventors: Arvind Patel, Naperville; Jack J. Schafer, LaGrange, both of Ill.

[73] Assignee: Molex Incorporated, Lisle, Ill.

[21] Appl. No.: 556,869

[22] Filed: Nov. 2, 1995

[51] Int. Cl.[6] ..... H01R 13/60

[52] U.S. Cl. ..... 439/567; 439/571

[58] Field of Search ..... 439/567, 571, 439/572

[56] References Cited

U.S. PATENT DOCUMENTS

| | | | |
|---|---|---|---|
| 4,384,754 | 5/1983 | Donty et al. | 339/17 |
| 4,688,875 | 8/1987 | O'Connor | 437/676 |
| 4,767,355 | 8/1988 | Phillipson et al. | 439/425 |
| 4,824,398 | 4/1989 | Taylor | 439/557 |
| 4,850,902 | 7/1989 | Reed | 439/676 |
| 4,953,061 | 8/1990 | Nitkiewicz | 361/417 |
| 5,076,804 | 12/1991 | Bertho et al. | 439/567 |
| 5,112,235 | 5/1992 | Enomoto et al. | 439/857 |
| 5,244,412 | 9/1993 | Hatch et al. | 439/567 |
| 5,334,048 | 8/1994 | Bowers et al. | 439/567 |
| 5,364,294 | 11/1994 | Hatch et al. | 439/676 |

FOREIGN PATENT DOCUMENTS

| | | | |
|---|---|---|---|
| 511655A2 | 4/1992 | European Pat. Off. | H01R 23/70 |

*Primary Examiner*—Gary F. Paumen
*Assistant Examiner*—T. C. Patel
*Attorney, Agent, or Firm*—Stephen Z. Weiss

[57] ABSTRACT

An electrical connector is adapted from mounting to a printed circuit board having a mounting hole. The connector includes a terminal housing having at least one mounting peg insertable through the hole in an axial direction. The mounting peg is bifurcated to define a pair of legs separated by an axial slit. One of the legs is a generally straight leg having a smooth outside surface facing one side of the hole inner wall. The other leg is a hooked leg having a radially outwardly extending hook for latching beneath a surface of the printed circuit board at an opposite side of the hole inner wall. The generally straight leg includes a radially outwardly projecting rib spaced axially at a base of the generally straight leg near the terminal housing. The hooked leg includes a reduced cross-sectional area near a base of the hooked leg near the terminal housing.

9 Claims, 5 Drawing Sheets

ELECTRIC CONNECTOR BOARDLOCK

FIELD OF THE INVENTION

This invention generally relates to the art of electrical connectors and, particularly, to a boardlock for securing an electrical connector to a printed circuit board through a hole in the board.

BACKGROUND OF THE INVENTION

It is known to provide electrical connectors with means for securing the connector to a printed circuit board. Often, the connector has a molded thermoplastic housing and a boardlock means is formed integral therewith. The connector is secured temporarily on the printed circuit board by the boardlock until electrical connections are made, as by soldering. The boardlock holds a connector mounting face firmly in contact with the printed circuit board until permanently secured thereagainst, such as a result of the soldering process.

A popular form of boardlock is a snap latch for securing a connector block or housing to the printed circuit board. The snap latch typically is a molded plastic peg which is bifurcated to define a pair of resilient legs having latching barbs or hooks thereon. The legs, during insertion through a hole in the printed circuit board from a first side of the board, deflect inwardly toward the axis of the snap latch. As the hooks on the ends of the legs pass through the hole in the board, the legs snap back into a position with shoulders on the hooks extending beyond the periphery of the hole and engaging a second side of the board, thereby securing the connector to the board. The pegs usually are an integral part of the connector housing or, in some instances, separate metal snap latches have been used.

Such snap latch boardlocks as described above have proven quite effective when employed with relatively large holes in the printed circuit board. However, with the ever increasing miniaturization of electronic components, miniature snap latches of the bifurcated peg type have proven to be extremely fragile, prone to breakage, unstable and lacking in sufficient retention capabilities. Furthermore, tolerances are extremely tight and manufacturing constraints result in the rejection of many parts because they are either too tight or too loose.

This invention is directed to solving the above problems by providing a new and improved peg configuration for this type of boardlock. The improved peg allows for insertion into a hole in the printed circuit board with minimum insertion forces over a considerable depth of the hole, and the peg has only one hooked leg which is provided with improved resiliency.

SUMMARY OF THE INVENTION

An object, therefore, of the invention is to provide a new and improved electrical connector boardlock of the type having resilient mounting pegs for insertion through mounting holes in a printed circuit board.

In the exemplary embodiment of the invention, the electrical connector has a terminal housing with at least one mounting peg insertable through the hole in an axial direction. The mounting peg is bifurcated to define a pair of legs separated by an axial slit. One of the legs is considered a generally straight leg having a generally smooth outside surface facing one side of the hole. The other leg is a hooked leg having a radially outwardly extending hook for latching beneath a surface of the printed circuit board at an opposite side of the hole. The diametrical distance between the smooth outside surface of the generally straight leg and the radial extremity of the hook of the hooked leg is less than the dimension of the hole between said sides to allow insertion of the mounting peg into the hole with minimum insertion forces.

The generally straight leg includes a radially outwardly projecting rib spaced axially of a proximal end thereof. The distance between the outside of the straight leg rib and the radial extremity of the hook of the hooked leg is greater than the diameter of the hole between said sides to require the hooked leg to flex inwardly to allow the mounting peg to be inserted into the hole until the hook clears the surface of the printed circuit board.

As disclosed in the preferred embodiment, the straight leg rib is located at a base of the generally straight leg near the terminal housing. The straight leg rib extends axially more than one-half the thickness of the printed circuit board. The slit extends axially into the mounting peg from a distal end thereof a distance relative to the depth of the mounting hole such that the slit extends only partially into the hole when the connector is properly mounted to the printed circuit board.

In addition, the hooked leg includes a reduced cross-sectional area axially spaced from the hook in a direction toward the axial slit. The reduced cross-sectional area is located near a base of the hooked leg near the terminal housing. Lastly, it is contemplated that the hooked leg include an axially extending, radially outwardly projecting rib on the outside thereof facing the opposite side of the hole in the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
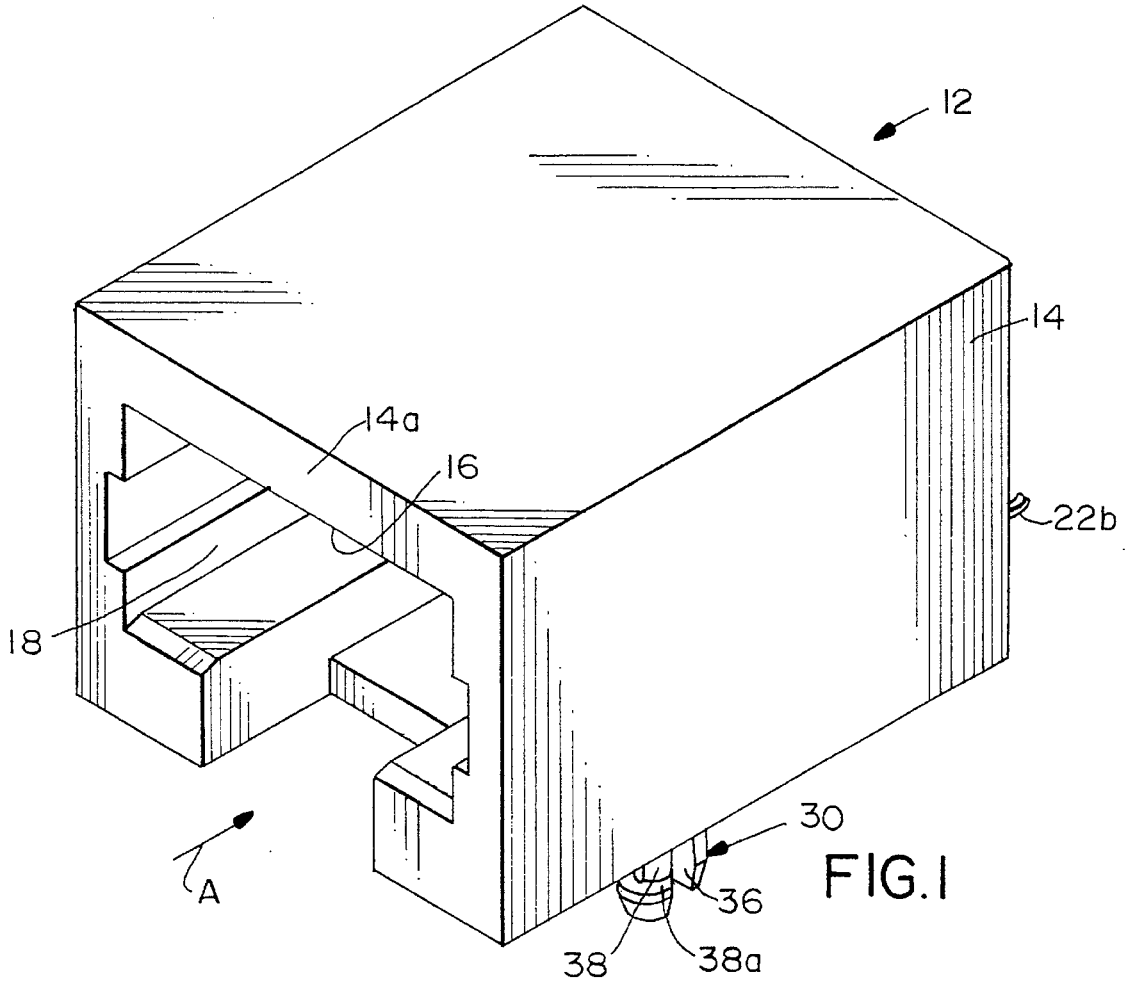
FIG. 1 is a perspective view of an electrical connector embodying the boardlock of the invention.
Figure 2:
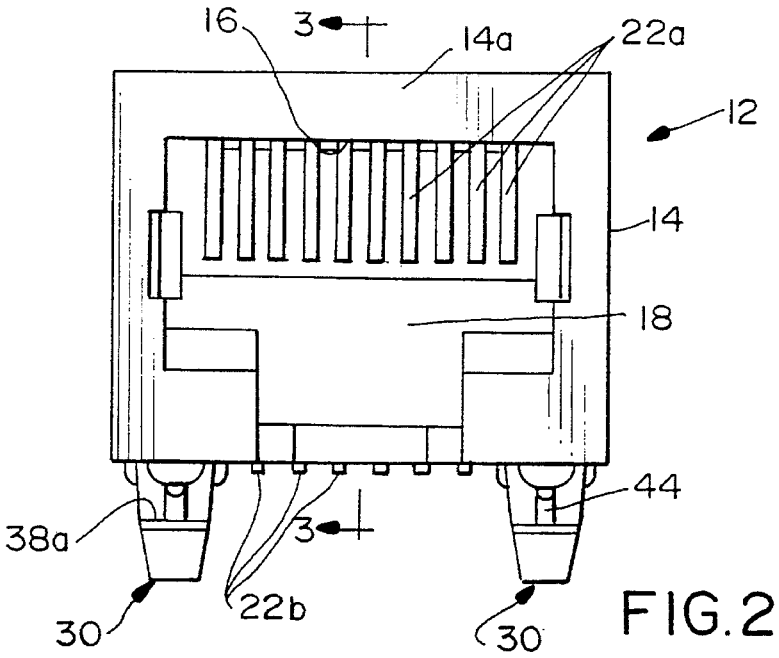
FIG. 2 is a front elevational view of the connector, as looking toward the left-hand side of FIG. 1.

Referring to the drawings in greater detail, and first to FIGS. 1 and 2, the boardlock system of the invention is incorporated in a miniature electrical connector, namely a telephone jack, generally designated 12. However, it should be understood that the concepts of the invention are equally applicable for incorporation in other types of electrical connectors.

Connector or jack 12 is of a generally conventional construction in that it includes a terminal housing 14 having a mating face 14*a* defining an opening 16 to a cavity 18 for receiving a conventional telephone plug inserted into the cavity in the direction of arrow "A" (FIG. 1). The jack is adapted for surface-mounting on a printed circuit board.

Figure 3:
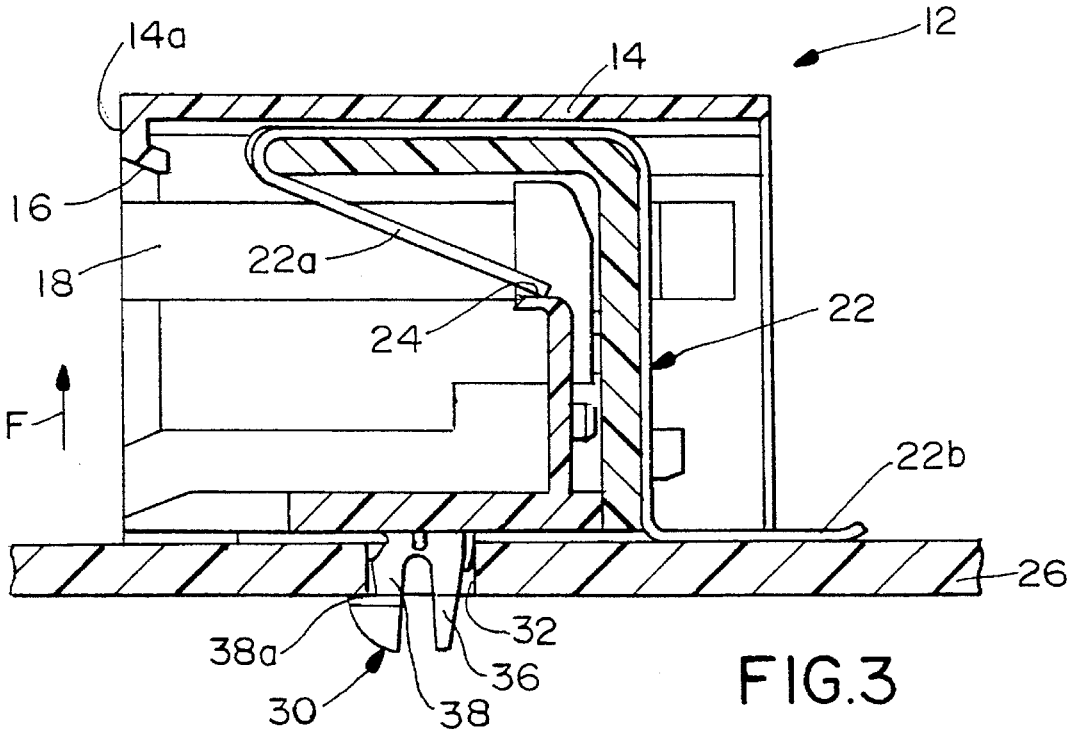
FIG. 3 is a vertical section taken generally along line 3—3 of FIG. 2.
Figure 4:
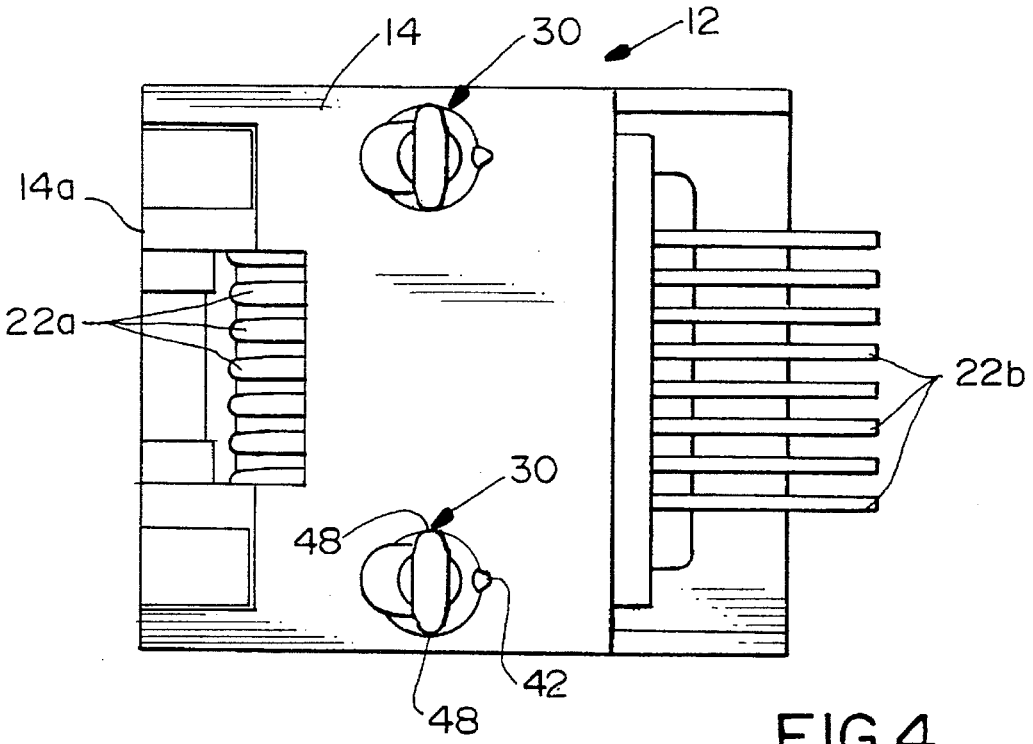
FIG. 4 is a bottom plan view of the connector.

Referring to FIGS. 3 and 4 in conjunction with FIGS. 1 and 2, a plurality of terminals, generally designated 22 (FIG. 3), are mounted in housing 14 transversely spaced across cavity 18. In particular, each terminal includes a spring contact portion 22*a* preloaded against a shoulder 24 within cavity 18. The spring contact portions are in the form of cantilevered spring arms for engagement by contacts on the telephone jack. Each terminal also includes a tail portion or leg 22*b* for electrical connection, as by soldering, to a respective one of a plurality of circuit traces on a printed circuit board 26 as best seen in FIG. 3. Therefore, electrical connector or jack 12 is effective for interconnecting a plug inserted into cavity 18 of terminal housing 14 to appropriate circuit traces on the printed circuit board.

Figure 5:
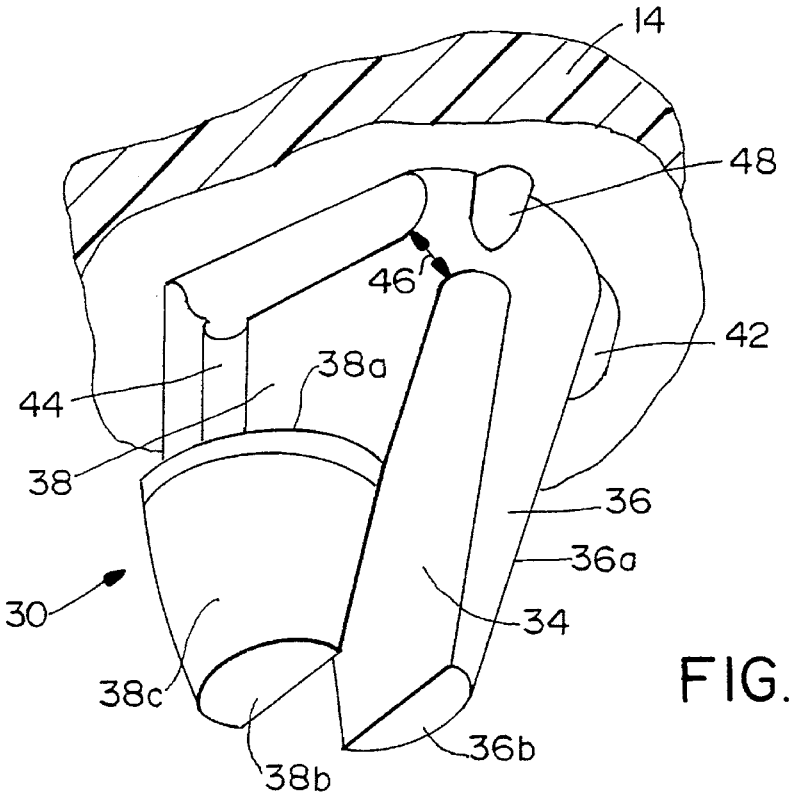
FIG. 5 is a fragmented perspective view, on an enlarged scale, looking toward the distal end of one of the boardlocks.
Figure 6:
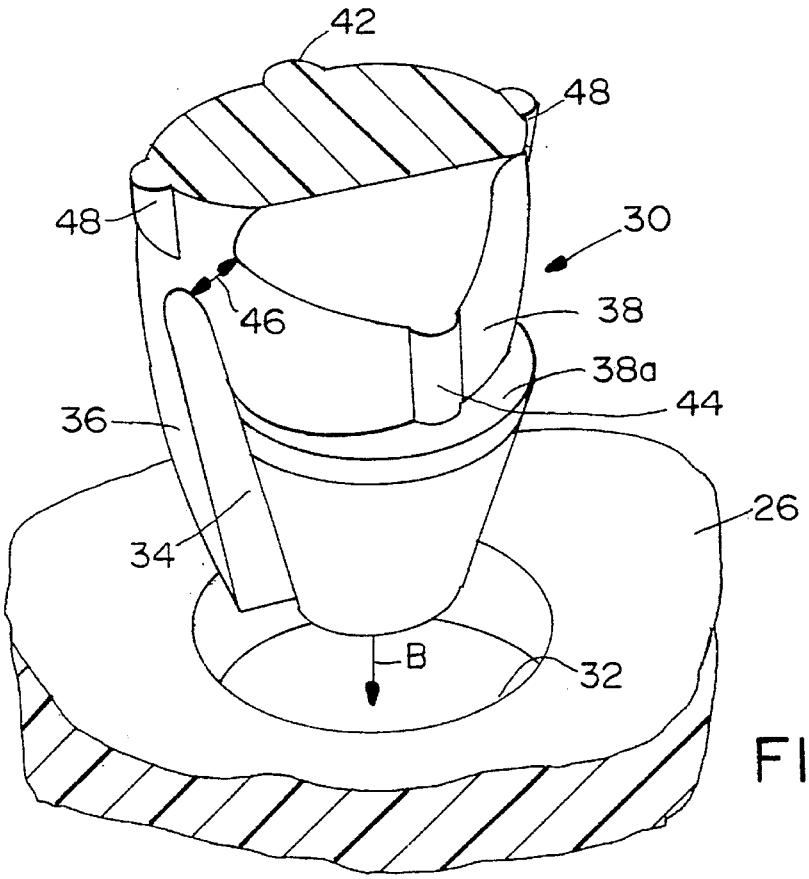
FIG. 6 is a fragmented perspective view of one of the boardlocks about to be inserted into a hole in a printed circuit board.
Figure 7:
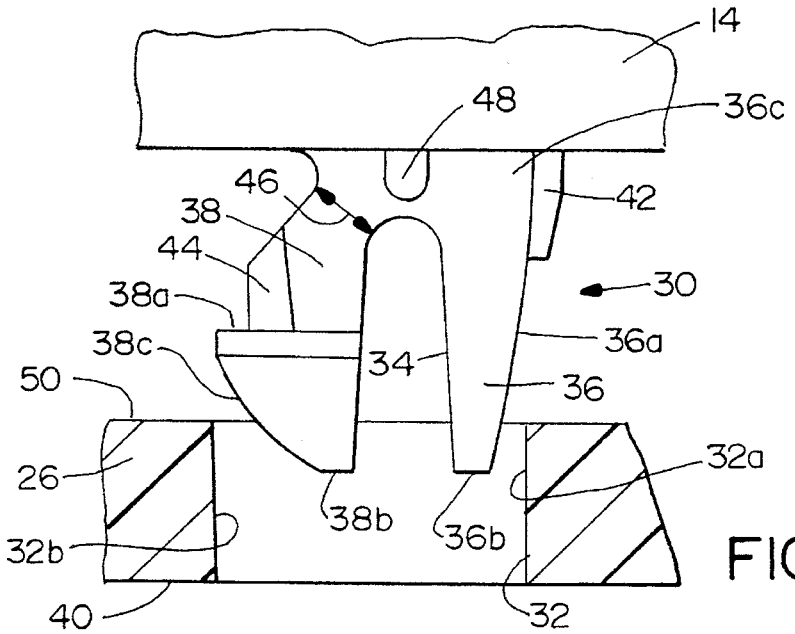
FIGS. 7–11 are sequential views of inserting one of the boardlocks through the hole in the printed circuit board.

Referring to FIGS. 5–7 in conjunction with FIGS. 1–4, the invention is embodied in a boardlock system which includes at least one mounting peg, generally designated 30, insertable through a hole 32 (FIGS. 3, 6 and 7) in printed circuit board 26, in an axial direction in the direction of arrow "B" (FIG. 6). Actually, as seen in FIGS. 2 and 4, a pair of mounting pegs 30 depend from terminal housing 14 transversely spaced of the housing. The mounting pegs are of a molded plastic construction integrally molded with and projecting from the underside of the terminal housing.

More particularly, referring specifically to FIGS. 5–7, each mounting peg 30 is bifurcated to define a pair of legs separated by an axial slit 34. One of the legs is a generally straight leg 36 having a smooth outside surface 36*a* facing one side 32*a* of hole 32 inner wall as best seen in FIG. 7. The other of the pair of legs is a hooked leg 38 having a radially outwardly extending hook 38*a* for latching beneath a surface 40 of printed circuit board 26 at an opposite side 32*b* of hole 32 inner wall.

Generally straight leg 36 of bifurcated mounting peg 30 includes a radially outwardly projecting rib 42 spaced axially of a proximal end 36*c* of the straight leg. The rib is located at a base of the straight leg near terminal housing 14 as best seen in FIG. 7. The rib extends axially from the center of the mounting peg more than one-half the thickness of printed circuit board 26.

Hooked leg 38 of bifurcated mounting peg 30 includes an axially extending, radially outwardly projecting rib 44 on the outside thereof facing side 32*b* of hole 32 in printed circuit board 26. Rib 44 extends upwardly from hook 38*a* as best seen in FIG. 7. The hooked leg also includes a reduced cross-sectional area as indicated by double-headed arrow 46 in FIG. 7. The reduced cross-sectional area is axially spaced from hook 38*a* in a direction toward terminal housing 14. The reduced cross-sectional area is located near the base of the hooked leg near terminal housing 14 as seen in FIG. 7.

Lastly, bifurcated mounting peg 30 includes a pair of radially outwardly projecting short ribs 48 spaced 90° from ribs 42 and 44 circumferentially about the peg. The short ribs 48 will engage sides of the inner wall of hole 32 in printed circuit board 26 spaced 90° from sides 32*a* and 32*b* of the hole inner wall when the mounting peg is fully inserted through the hole.

FIGS. 7–11 show one of the bifurcated mounting pegs 30 in sequential positions of insertion through hole 32 in printed circuit board 26. In particular, FIG. 7 shows the mounting peg just slightly inserted into the hole, with distal end 36*b* of generally straight leg 36 and a distal end 38*b* of hooked leg 38 slightly passing a top surface 50 of the printed circuit board. It can be seen that substantial clearance is provided between smooth outside surface 36*a* of the straight leg and a curved outside surface 38*c* of hooked leg 38.

Figure 8:
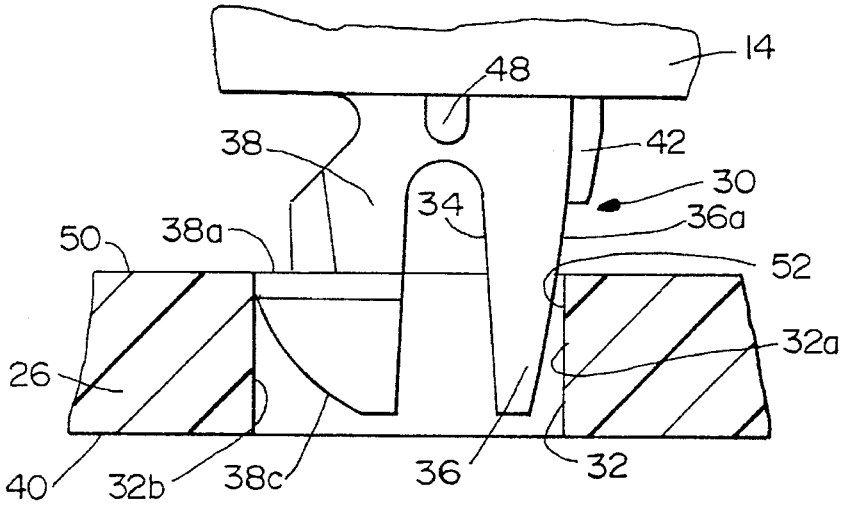

FIG. 8 shows mounting peg 30 inserted into hole 32 to an extent that hook 38*a* of hooked leg 38 now has cleared top surface 50 of the printed circuit board and is located within the hole. Although hook 38*a* is engaging side 32*b* of the hole, clearance, as at 52, still is provided between outside surface 36*a* of straight leg 36 and side 32*a* of the hole. In other words, the diametrical distance between outside surface 36*a* of generally straight leg 36 and the radial extremity of hook 38*a* of hooked leg 38, is less than the diameter of hole 32 between sides 32*a* and 32*b* of the hole. This allows the mounting peg to be inserted into the hole with minimum insertion forces even though hook 38*a* is disposed inside the hole.

Figure 9:
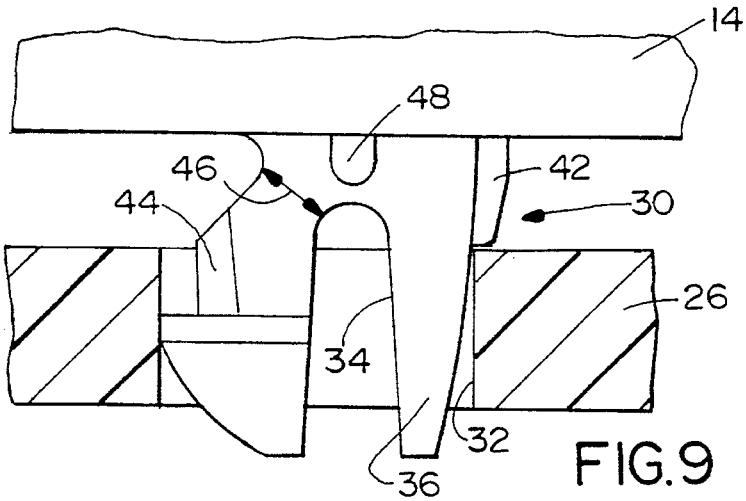

FIG. 9 shows mounting peg 30 further inserted into hole 32 in printed circuit board 26, but not to an extent whereby rib 42 has yet to enter the hole. It can be understood that the peg still is being inserted into the hole with zero insertion forces.

Figure 10:
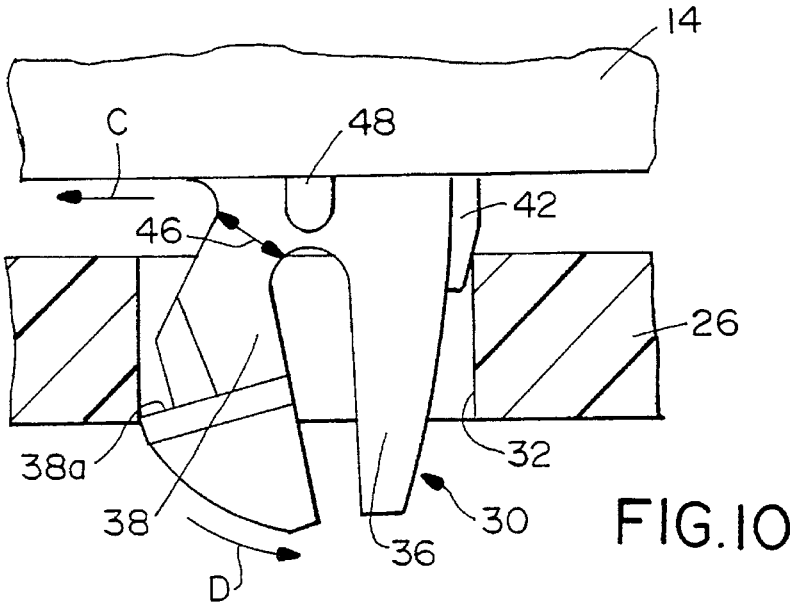
Figure 12:
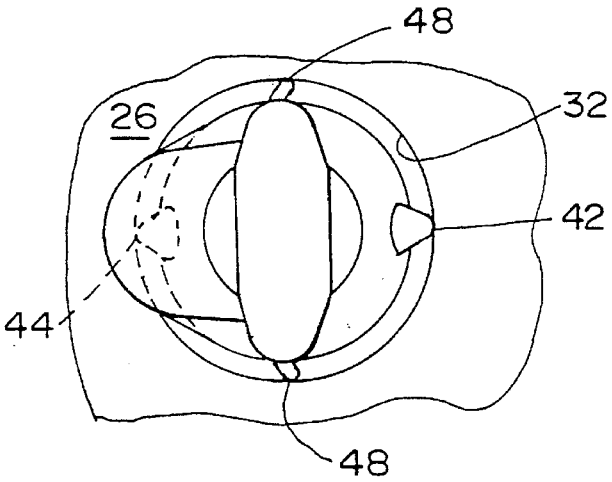
FIG. 12 is a bottom view of the peg shown in FIG. 11.

FIG. 10 shows mounting peg 30 inserted into hole 32 in printed circuit board 26 to an extent that rib 42 on the outside of straight leg 36 now has entered the hole. Both manual movement and thickened portion rib 42 are effective in sliding the connector relative to the printed circuit board radially of the hole in the direction of arrow "C" (FIG. 10). This causes hooked leg 38 to flex inwardly in the direction of arrow "D" about its reduced cross-sectional area 46. In other words, rib 42, being located at the base of generally straight leg 36 near terminal housing 14 provides a structure having a greater stiffness than the reduced cross-sectional area 46 about which hooked leg 38 flexes. As shown in FIG. 12, after the peg 30 has slid in the direction C so that generally straight peg 42 is aligned for complete insertion into hole 32, straight ribs 48 are also aligned for complete insertion into hole 32. The circumference of a circle short by the slant ribs 48 and rib 42 is slightly greater than the diameter of hole 32. Therefore, the slant ribs 48 and rib 42 may deform slightly in the hole 32 when fully inserted, ensuring the peg 30 a firm fit in the hole 32.

Figure 11:
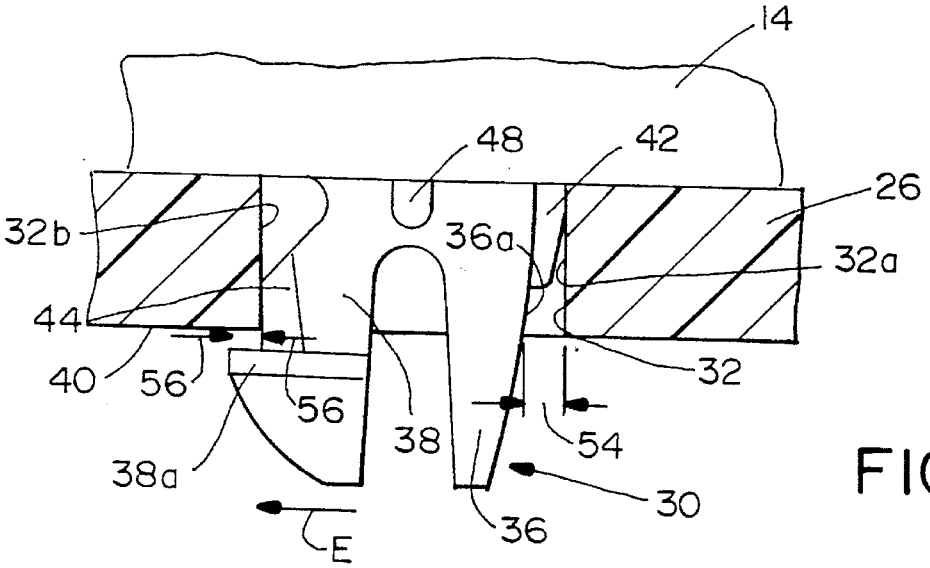

FIG. 11 shows the final step in inserting mounting peg 30 through hole 32 in printed circuit board 26. It can be seen that hook 38*a* of hooked leg 38 now has passed surface 40 of printed circuit board 26 whereby the hooked leg can snap back outwardly in the direction of arrow "E" under its inherent plastic resiliency. When the mounting peg is fully inserted into the hole, rib 42 on the outside of straight leg 36 engages side 32*a* of the hole inner wall, and rib 44 on the outside of hooked leg 38 engages the opposite side 32*b* of the hole.

In FIG. 11, the distance represented by double-headed arrow 54 represents the distance between outside surface 36*a* of generally straight leg 36 and side 32*a* of hole 32 inner wall at a point in line with surface 40 of the board when the connector is properly mounted to the board (i.e. substantially diametrically opposite to hook 38*a*). This distance is greater than the radial dimension of hook 38*a* as represented by arrows 56 at opposite side 32*b* of the hole. It has been found that by making distance 54 greater than the radial dimension 56 of hook 38*a*, the mounting peg can be inserted substantially into hole 32 with minimum insertion forces as seen in describing the extent of insertion of the mounting peg in FIG. 8.

In reviewing the insertion stages represented by FIGS. 7–11, it can be seen that mounting peg 30 is inserted into hole 32 in printed circuit board 26 with minimum insertion forces through a substantial portion of its insertion movement as represented by FIGS. 7, 8 and 9. Hooked leg 38 does not begin to flex radially inwardly until rib 42 on the outside of straight leg 36 begins to enter the hole as shown in FIG. 10. As stated above, once hook 38*a* of hooked leg 38 clears surface 40 of the printed circuit board, the hooked leg then snaps back out to its normal unstressed condition.

Lastly, referring back to FIG. 3, it can be seen that hooks 38*a* of mounting pegs 30 project forwardly toward mating face 14*a* of terminal housing 14. Therefore, when a telephone plug is inserted into cavity 18 of jack 12, the hooks will oppose any forces from the plug tending to rotate the housing upwardly and away from the printed circuit board in the direction of arrow "F".

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. An electrical connector for mounting to a surface of a printed circuit board having a mounting hole with an inner wall, comprising:

a terminal housing having at least one mounting peg insertable into the mounting surface of the printed circuit board through the hole in an axial direction, the mounting peg being bifurcated to define a pair of legs separated by an axial slit, one of said legs being a generally straight leg having a smooth outside surface facing one side of said inner wall of the hole, the other of said legs being a hooked leg having a radially outwardly projecting hook having a radial extremity, through which passes a line parallel to the axis, for latching beneath a lower surface of the printed circuit board at an opposite side of the hole inner wall, the distance between said outside surface of the straight leg and the radial extremity line of said hook of the hooked leg being less than the diameter of the inner wall of the hole between said sides to allow insertion of the mounting peg into the hole with minimal insertion forces; and the generally straight leg including a radially outwardly projecting rib spaced axially of a proximal end thereof and having a straight leg rib axial extremity, through which passes a line parallel to the axis, the distance perpendicular to and between both the straight leg rib axial extremity line and the hook radial extremity line being greater than the diameter of the hole between said sides of the inner hole wall to require the hooked leg to flex inwardly to allow the mounting peg to be inserted into the hole until the hook clears the lower surface of the printed circuit board opposite the mounting surface.

2. The electrical connector of claim 1 wherein said hooked leg includes an axially extending, radially outwardly projecting rib on the outside thereof facing said opposite side of the hole in the printed circuit board.

3. The electrical connector of claim 1 wherein said generally straight leg rib is located at a base of the generally straight leg near the terminal housing.

4. The electrical connector of claim 3 wherein said generally straight leg rib extends axially from the base of the generally straight leg of the mounting peg more than one-half the thickness of the printed circuit board.

5. The electrical connector of claim 3 wherein said slit extends axially into the mounting peg from a distal end thereof a distance relative to the depth of the mounting hole such that the slit extends only partially into the hole when the connector is properly mounted to the printed circuit board.

6. The electrical connector of claim 3 wherein a proximal end of the mounting peg has a pair of radially outwardly projecting short ribs space 90 degrees from the generally straight leg rib and adapted to contact the hole inner wall when the connector is properly mounted to the printed circuit board.

7. The electrical connector of claim 1 wherein said hooked leg includes a reduced cross-sectional area axially spaced from the hook in a direction toward the terminal housing.

8. The electrical connector of claim 7 wherein said reduced cross-sectional area is located near a base of the hooked leg near the terminal housing.

9. The electrical connector of claim 8 wherein said rib on the straight leg is located at a base of the straight leg near the terminal housing.

* * * * *